US009404456B2

(12) United States Patent
Okamoto et al.

(10) Patent No.: US 9,404,456 B2
(45) Date of Patent: Aug. 2, 2016

(54) FUEL INJECTION VALVE

(71) Applicant: Hitachi Automotive Systems, Ltd., Hitachinaka-shi, Ibaraki (JP)

(72) Inventors: Yoshio Okamoto, Omitama (JP); Yoshihito Yasukawa, Hitachinaka (JP); Noriyuki Maekawa, Kashiwa (JP); Nobuaki Kobayashi, Maebashi (JP); Takahiro Saito, Isesaki (JP)

(73) Assignee: Hitachi Automotive Systems, Ltd., Tokyo (JP)

( * ) Notice: Subject to any disclaimer, the term of this patent is extended or adjusted under 35 U.S.C. 154(b) by 213 days.

(21) Appl. No.: 13/737,645

(22) Filed: Jan. 9, 2013

(65) Prior Publication Data

US 2013/0175367 A1 Jul. 11, 2013

(30) Foreign Application Priority Data

Jan. 11, 2012 (JP) ..... 2012-002682

(51) Int. Cl.

| | |
|---|---|
| ***B05B 1/34*** | (2006.01) |
| ***F02M 51/06*** | (2006.01) |
| ***F02M 61/16*** | (2006.01) |
| ***F02M 61/18*** | (2006.01) |

(52) U.S. Cl.

CPC ..... *F02M 51/061* (2013.01); *F02M 51/0664* (2013.01); *F02M 61/162* (2013.01); *F02M 61/1853* (2013.01)

(58) Field of Classification Search

CPC ..... F02M 61/1853; F02M 61/162; F02M 51/061; F02M 51/0664

USPC ..... 239/463, 466, 468, 533.12

See application file for complete search history.

(56) References Cited

U.S. PATENT DOCUMENTS

| | | | | |
|---|---|---|---|---|
| 5,109,824 | A * | 5/1992 | Okamoto et al. | 123/472 |
| 6,405,945 | B1 | 6/2002 | Dobrin | |
| 6,854,670 | B2 | 2/2005 | Sumisha et al. | |
| 7,021,569 | B1 | 4/2006 | Ogura et al. | |
| 8,342,430 | B2 | 1/2013 | Ohno et al. | |
| 8,567,701 | B2 * | 10/2013 | Hashii et al. | 239/601 |
| 2003/0127547 | A1 | 7/2003 | Nowak | |
| 2003/0234005 | A1 | 12/2003 | Sumisha et al. | |
| 2004/0050970 | A1 | 3/2004 | Bowman et al. | |

(Continued)

FOREIGN PATENT DOCUMENTS

| | | | |
|---|---|---|---|
| CN | 1396987 | A | 2/2003 |
| CN | 102200083 | A | 9/2011 |

(Continued)

OTHER PUBLICATIONS

Chinese Office Action dated Sep. 1, 2014 (seven pages).

(Continued)

*Primary Examiner* — Jason Boeckmann
(74) *Attorney, Agent, or Firm* — Crowell & Moring LLP

(57) ABSTRACT

One passage for swirling is formed in an orifice plate fixed on a nozzle body. Two swirl chambers in which fuel is caused to swirl so that the fuel has swirling force are provided at an end of the one passage for swirling on the downstream side of the flow direction of fuel. Therefore, the collision between the swirling flow in the swirl chamber and the fuel flowing in the passage for swirling is mitigated, and the swirling flow can be smoothly produced to promote pulverization of sprays injected from fuel injection ports.

15 Claims, 8 Drawing Sheets

(56) References Cited

U.S. PATENT DOCUMENTS

| | | | | |
|---|---|---|---|---|
| 2006/0097081 | A1 | 5/2006 | Goenka et al. | |
| 2009/0194611 | A1 | 8/2009 | Whittaker et al. | |
| 2011/0233307 | A1 * | 9/2011 | Ohno | F02M 51/0646 239/463 |

FOREIGN PATENT DOCUMENTS

| | | | |
|---|---|---|---|
| JP | 26-406 | U | 1/1926 |
| JP | 55-39376 | B2 | 10/1980 |
| JP | 2-125956 | A | 5/1990 |
| JP | 2003-336562 | A | 11/2003 |
| JP | 3715253 | B2 | 11/2005 |
| JP | 2008-280981 | A | 11/2008 |
| JP | 2011-196328 | A | 10/2011 |

OTHER PUBLICATIONS

Japanese Office Action dated May 12, 2015 with English-language translation (nine (9) pages).

Japanese Office Action issued in counterpart Japanese Application No. 2012-002682 dated Dec. 10, 2015 with English translation (eight pages).

* cited by examiner

FUEL INJECTION VALVE

BACKGROUND OF THE INVENTION

The present invention relates to a fuel injection valve used in an internal combustion engine and, more particularly, to a fuel injection valve having a plurality of fuel injection ports and capable of injecting swirling jets of fuel from the fuel injection ports and thereby improving the pulverizing performance.

A fuel injection valve described in JP-A-2003-336562 is known as a conventional art for promoting pulverization of fuel injected from a plurality of fuel injection ports by using swirling flows.

This fuel injection valve has a valve seat member in which a downstream end of a valve seat cooperating with a valve element is opened in a front end surface, and an injector plate joined to the front end surface of the valve seat member. Between the valve seat member and the injector plate, lateral passages and swirl chambers are formed, wherein the lateral passages communicate with the downstream end of the valve seat, and wherein downstream ends of the lateral passages are opened to the swirl chambers along tangential directions. Fuel injection ports through which fuel caused to swirl in the swirl chambers is injected are formed as holes in the injector plate. Each fuel injection port is disposed offset from a center of the swirl chamber to the upstream end side of the lateral passage by a predetermined distance.

In this fuel injection valve, the radius of curvature of an inner peripheral surface of each swirl chamber is reduced from the upstream side toward the downstream side in a direction along the inner peripheral surface of the swirl chamber. That is, the curvature is increased from the upstream side toward the downstream side in the direction along the inner peripheral surface of the swirl chamber. Also, the inner peripheral surface of the swirl chamber is formed along an involute curve having a base circle in the swirl chamber.

With this arrangement, pulverization of fuel from each fuel injection port can be effectively promoted.

On the other hand, a fuel injection valve described in JP-A-2008-280981 is known as a conventional art for obtaining high-dispersion sprays by using swirling force.

This fuel injection valve has an orifice plate having a plurality of fuel injection ports through which fuel is injected. From the fuel injection ports, curved sprays having swirling force are injected. The fuel injection ports are disposed close to each other to cause the curved sprays collide against each other so that pulverization is promoted.

SUMMARY OF THE INVENTION

In the conventional art described in JP-A-2003-336562, one side wall constituting each lateral passage (a side wall connected to an upstream-side end portion of a swirl chamber inner peripheral wall along the fuel swirl direction) is connected to the inner peripheral wall of the swirl chamber in such a manner as to form a line tangent to the inner peripheral wall, while the other side wall (a side wall connected to a downstream-side end portion of the swirl chamber inner peripheral wall along the fuel swirl direction) is provided in such a manner as to intersect the inner peripheral wall of the swirl chamber. Therefore a connection portion of the two walls at which the other side wall and the swirl chamber inner peripheral wall intersect has a shape with a sharp projecting end like a knife edge.

At such a connection portion, when only a minute error occurs in positioning the side wall of the lateral passage or the swirl chamber inner peripheral wall, an error in positioning the connection portion of the two walls can occur easily. Due to such an error in positioning the connection portion, an abrupt one-sided flow to the fuel injection port can possibly occur, whereby the one-sided flow impairs the symmetry (uniformity) of the swirling flow.

In the conventional art described in JP-A-2008-280981, the swirl chamber in which fuel is caused to swirl has the shape of a complete circle. In such a swirl chamber, a fast flow is locally formed, so that a spray curved along the swirl flow direction is injected. There is, therefore, a possibility of the symmetry (uniformity) of the swirling flow being impaired.

In view of the above-described circumstances, an object of the present invention is to provide a fuel injection valve designed to enable a swirling flow to smoothly flow along a peripheral direction in a swirl chamber.

To achieve the above-described object, according to the present invention, there is provided a fuel injection valve including at least one swirl chamber having an inner peripheral wall formed so that the curvature is gradually increased from the upstream side to the downstream side of a fuel flow, at least one passage for swirling through which fuel is led into the swirl chamber, and at least one fuel injection port opened into the swirl chamber, wherein the at least one passage for swirling has a downstream end provided with two swirl chambers.

According to the present invention, a swirling flow can be smoothly formed in the swirl chamber to promote pulverization of a spray injected from the fuel injection port.

Other objects, features and advantages of the invention will become apparent from the following description of the embodiments of the invention taken in conjunction with the accompanying drawings.

DETAILED DESCRIPTION OF THE INVENTION

Embodiments of the present invention will be described with reference to FIGS. 1 to 7.

A first embodiment of the present invention will be described with reference to FIGS. 1 to 5.

First Embodiment

Figure 1:
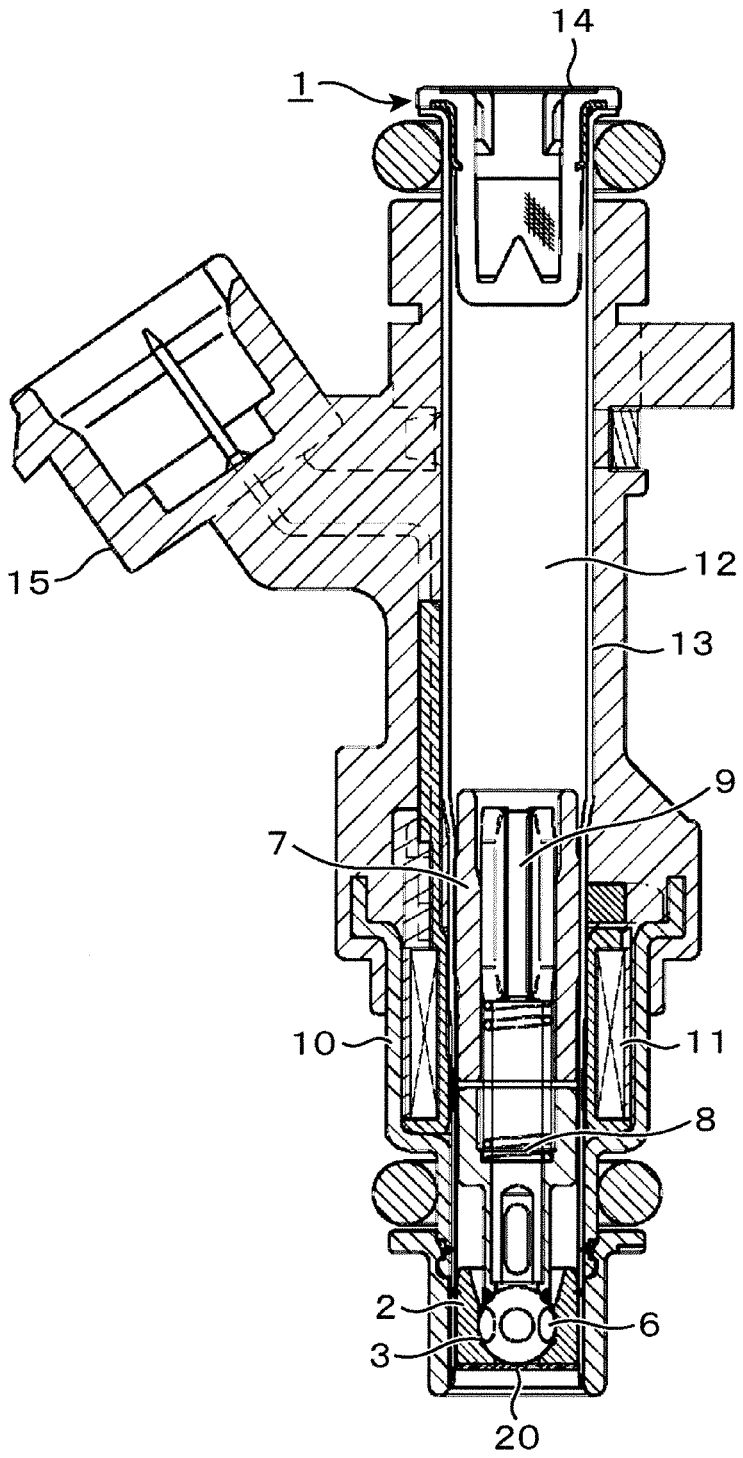
FIG. 1 is a longitudinal sectional view showing the entire construction of a fuel injection valve 1 according to the present invention.

FIG. 1 is a longitudinal sectional view showing the entire construction of a fuel injection valve 1 according to the present invention.

Referring to FIG. 1, the fuel injection valve 1 is of such a structure that a nozzle body 2 and a valve element 6 are housed in a thin pipe 13 made of stainless steel and that the valve element 6 is operated in a reciprocating manner (operated for opening/closing) by an electromagnetic coil 11 disposed outside the pipe 13. This structure will be described in detail below.

Figure 2:
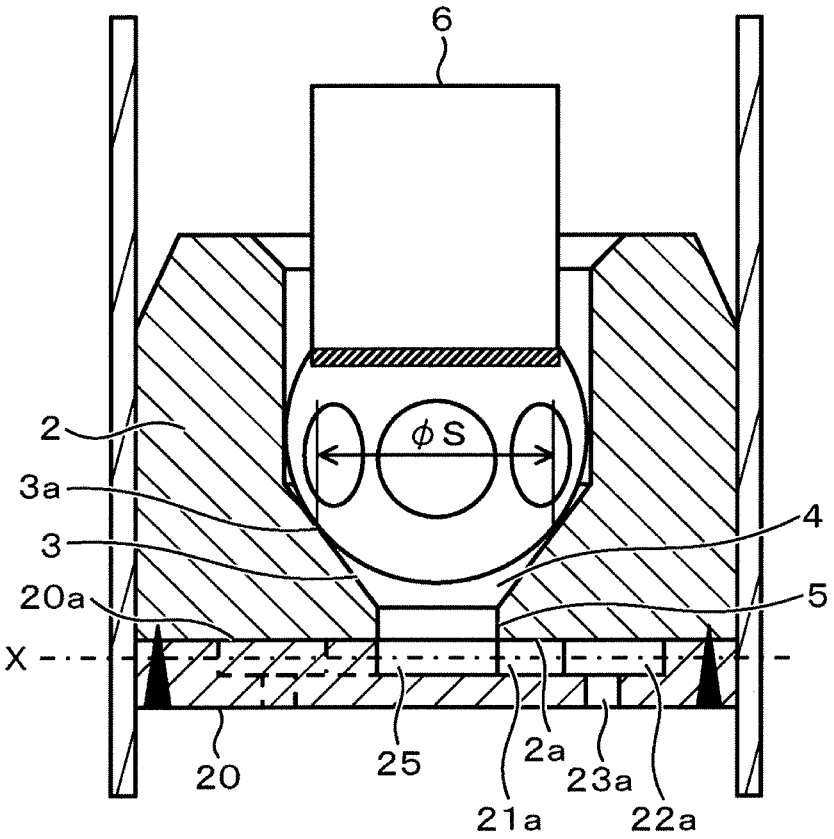
FIG. 2 is a longitudinal sectional view showing a nozzle body and portions in the vicinity of the nozzle body in the fuel injection valve according to the present invention.
Figure 3:
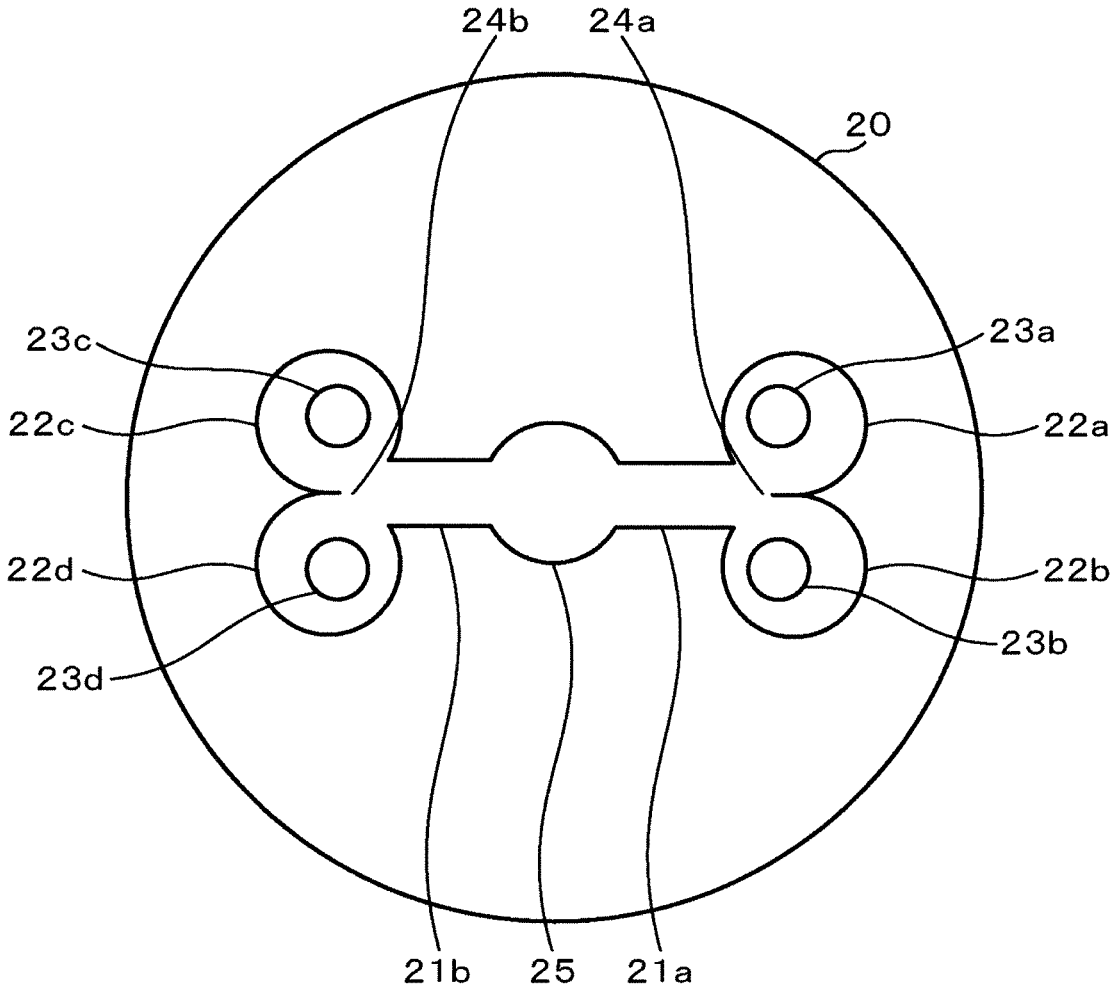
FIG. 3 is a plan view of an orifice plate positioned at the lower end of the nozzle body in the fuel injection valve according to the present invention.

The structure includes a yoke 10 made of a magnetic material and surrounding the electromagnetic coil 11, a core 7 positioned at a center of the electromagnetic coil 11 and maintained in magnetic contact with the yoke 10 at its one end, the valve element 6 liftable by a predetermined amount, a valve seat face 3 that contacts with the valve element 6, a fuel injection chamber 4 that allows fuel flowing through a gap between the valve element 6 and the valve seat face 3 to pass, and an orifice plate 20 provided downstream of the fuel injection chamber 4 and having a plurality of fuel injection ports 23*a*, 23*b*, 23*c*, and 23*d* (see FIGS. 2 and 3).

At a center of the core 7, a spring 8 is also provided as an elastic member for pressing the valve element 6 against the valve seat face 3. The elastic force of the spring 8 is adjusted through the amount of forcing of a spring adjustor 9 toward the valve seat face 3.

In a state where the coil 11 is not energized, the valve element 6 and the valve seat face 3 are maintained in intimate contact with each other. In this state, because a fuel passage is closed, fuel stays in the fuel injection valve 1 and fuel injection from the fuel injection ports 23*a*, 23*b*, 23*c*, and 23*d* is not performed.

When the coil 11 is energized, the valve element 6 is moved by electromagnetic force until the valve element 6 is brought into contact with a lower end surface of the opposite core 7.

In the valve opening state, since the gap is formed between the valve element 6 and the valve seat face 3, the fuel passage is opened to inject fuel from the plurality of fuel injection ports 23*a*, 23*b*, 23*c*, and 23*d*.

The fuel injection valve 1 has a fuel passage 12 having a filter 14 at an inlet. The fuel passage 12 includes a through hole portion extending through the center of the core 7 and is a passage for leading fuel pressurized by a fuel pump (not shown) to the fuel injection ports 23*a*, 23*b*, 23*c*, and 23*d* through the interior of the fuel injection valve 1. An outer portion of the fuel injection valve 1 is covered with a resin mold 15 to be electrically insulated.

The fuel injection valve 1 is operated by changing the position of the valve element 6 between the valve opening state and the valve closing state through energization of the coil 11 (application of injection pulses), as described above, thereby controlling the amount of supply of fuel.

A valve element is designed specifically for preventing leakage of fuel in the valve closing state in controlling the amount of supply of fuel, In this kind of fuel injection valve, a ball (ball bearing steel ball in accordance with HS) having a high degree of roundness and mirror-finished is used in the valve element 6. This ball is useful in improving the seating performance.

On the other hand, the valve seat angle of the valve seat face 3 that the ball intimately contacts with is set to an optimum angle of 80 to 100 degrees such that the polishability is good and the roundness can be obtained with high accuracy, and a size condition is selected for the valve seat face 3 such that the seating performance of the above-described ball can be maintained extremely high.

The hardness of the nozzle body 2 having the valve seat face 3 is increased by quenching. Further, unnecessary magnetism is removed from the nozzle body 2 by demagnetization processing.

The above-described construction of the valve element 6 enables injection amount control free from fuel leakage.

FIG. 2 is a longitudinal sectional view showing the nozzle body 2 and portions in the vicinity of the nozzle body 2 in the fuel injection valve 1 according to the present invention.

As shown in FIG. 2, an upper surface 20*a* of the orifice plate 20 is in contact with a lower surface 2*a* of the nozzle body 2, and the contact portion of the upper surface 20*a* of the orifice plate 20 is fixed to the nozzle body 2 by being laser-welded to the same at an outer peripheral position.

In this description and in the claims, the top-bottom direction is a direction defined with reference to FIG. 1, the fuel passage 12 side in the valve axial direction of the fuel injection valve 1 is assumed to be an upper side, and the fuel injection ports 23*a*, 23*b*, 23*c*, and 23*d* side is assumed to be a lower side.

A fuel inlet port 5 having a diameter smaller than the diameter ϕS of a seat portion 3*a* of the valve seat face 3 is provided in a lower end portion of the nozzle body 2. The valve seat face 3 has the shape of a circular cone. The fuel inlet port 5 is formed at a center of the downstream end of the valve seat face 3. The valve seat face 3 and the fuel inlet port 5 are formed so that the central axis of the valve seat face 3 and the central axis of the fuel inlet port 5 coincide with the central axis of the valve. The fuel inlet port 5 forms an opening, in the lower surface 2*a* of the nozzle body 2, communicating with a central hole (central port) 25 in the orifice plate 20.

The central hole 25 is a recessed portion provided in an upper surface 20*a* of the orifice plate 20. Passage 21*a* and 21*b* for swirling extend radially from the central hole 25. Upstream ends of the passages 21*a* and 21*b* for swirling are opened in an inner peripheral surface of the central hole 25 to communicate with the central hole 25.

A downstream end of the passage 21*a* for swirling is connected so as to communicate with swirl chambers 22*a* and 22*b*, while a downstream end of the passage 21*b* for swirling is connected so as to communicate with swirl chambers 22*c* and 22*d*. The passages 21*a* and 21*b* for swirling are each a fuel passage through which fuel is supplied to the swirl chambers 22*a* and 22*b* or to the swirl chambers 22*c* and 22*d*. In this sense, the passages 21*a* and 21*b* for swirling may be referred to as swirling fuel supply passages 21*a* and 21*b*.

Wall surfaces of the swirl chambers 22*a*, 22*b*, 22*c*, and 22*d* are formed so that the curvature increases gradually (the radius of curvature gradually becomes smaller) from the upstream side toward the downstream side. The curvature may be continuously increased or may be gradually increased stepwise from the upstream side toward the downstream side so that the curvature is constant in a predetermined range. Typical examples of a curve having the curvature continuously increased from the upstream side toward the downstream side are an involute curve (shape) and a spiral curve (shape). A spiral curve is described in the present embodiment. The same description can be made of any curve, such as described above, having the curvature gradually increased from the upstream side toward the downstream side.

Fuel injection ports 23*a*, 23*b*, 23*c*, and 23*d* are respectively opened at centers of the swirl chambers 22*a*, 22*b*, 22*c*, and 22*d*.

The nozzle body 2 and the orifice plate 20 are constructed so that the positioning in relation to each other can be performed easily in a simple way, thereby improving the dimensional accuracy in the assembly process of the nozzle body 2 and the orifice plate 20.

The orifice plate 20 is manufactured by press forming (plastic working), which is advantageous in terms of mass production. Methods other than press forming, e.g., electrodischarge machining, electroforming and etching, enabling working with high accuracy while causing comparatively small stress, are also conceivable.

The construction of the orifice plate 20 will be described in detail with reference to FIGS. 3 to 5. FIG. 3 is a plan view of the orifice plate 20 positioned at the lower end of the nozzle body in the fuel injection valve 1 according to the present invention.

In the orifice plate 20, the central hole 25 communicating with the fuel inlet port 5 is formed, and the two passages 21*a* and 21*b* for swirling are connected to the central hole 25. The two passages are arranged so as to extend radially in opposite directions from the central hole 25 toward outer peripheral sides. The two swirl chambers 22*a* and 22*b* are connected to the passage 21*a* for swirling and are placed in back to back relationship. Similarly, the two swirl chambers 22*c* and 22*d* are connected to the passage 21*b* for swirling and are placed in back to back relationship. There is no problem in flow in the passages 21*a* and 21*b* for swirling in the case where the outside diameter of the central hole 25 are set equal to the thickness (width) of the passages 21*a* and 21*b* for swirling.

The method of connecting the passage 21*a* for swirling and the swirl chambers 22*a* and 22*b* and the method of connecting the passage 21*b* for swirling and the swirl chambers 22*c* and 22*d* will be described in detail with reference to FIGS. 4 and 5. The relationships between these connections and the fuel injection ports 23*a*, 23*b*, 23*c*, and 23*d* will also be described in detail.

Figure 4:
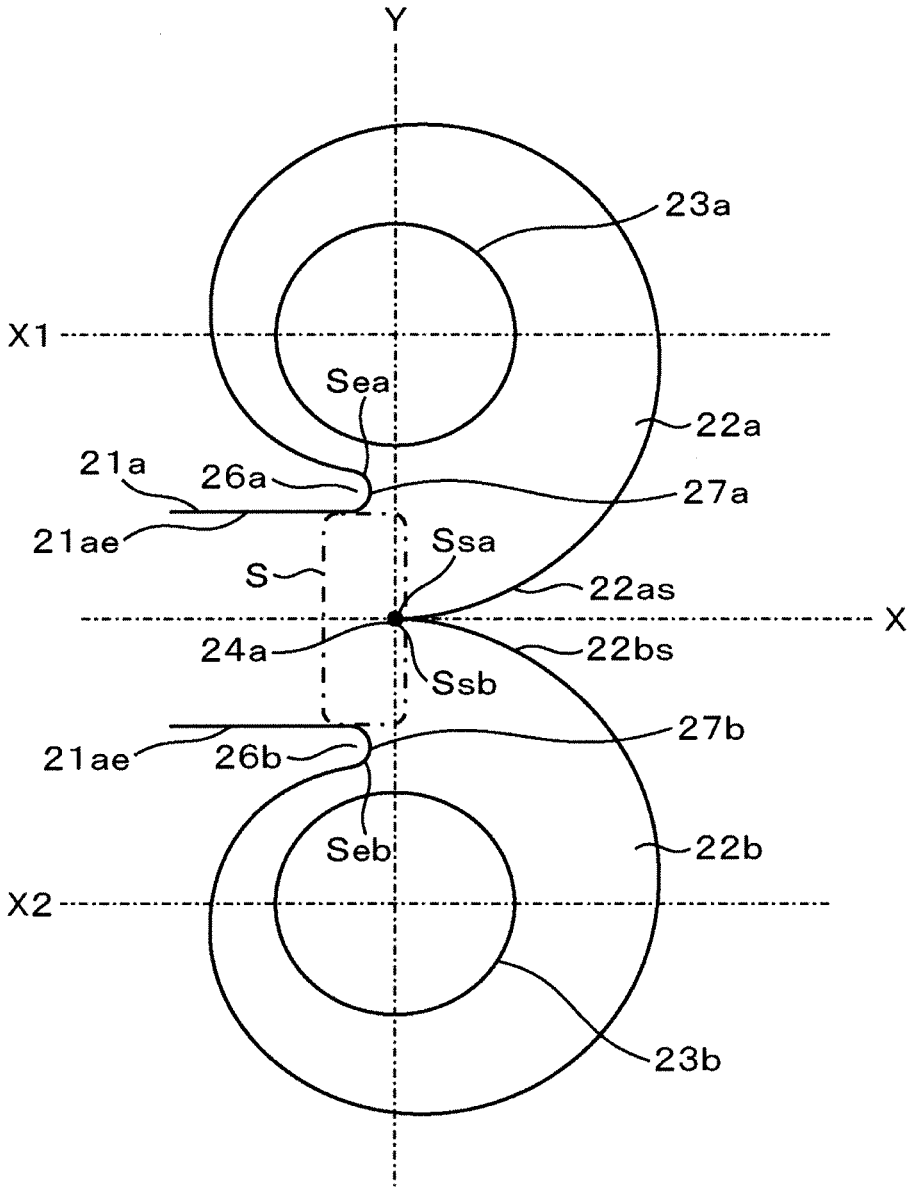
FIG. 4 is a plan view showing the relationships between swirl chambers, a passage for swirling and fuel injection ports in the fuel injection valve according to the present invention.

FIG. 4 is an enlarged plan view showing the connections between the passage 21*a* for swirling and the two swirl chambers 22*a* and 22*b* and the relationship with the fuel injection port 23*a*. FIG. 5 is a similar enlarged plan view but shows an arrangement in which a partially circular portion 29*a* having a desired thickness is provided between the two swirl chambers 22*a* and 22*b* placed in back to back relationship and the positional relationship between the partially circular portion 29*a* and the swirl chambers 22*a* and 22*b*.

A downstream end S of one passage 21*a* for swirling opens to and communicates with inlet portions of the swirl chambers 22*a* and 22*b*. The fuel injection port 23*a* opens at the center of the swirl chamber 22*a*, and the fuel injection port 23*b* opens at the center of the other swirl chamber 22*b*. In the present embodiment, the inner peripheral wall of the swirl chamber 22*a* is formed to draw a spiral curve on a plane (section) perpendicular to the central axis of the valve (see X in FIG. 2), that is, the inner peripheral wall of the swirl chamber 22*a* is in spiral shape and the spiral center of the spiral curve and the center of the fuel injection port 23*a* coincide with each other.

In the case where the swirl chamber 22*a* corresponds to an involute curve, it is preferable to construct so that the center of the base circle for the involute curve and the center of the fuel injection port 23*a* coincide with each other. The center of the fuel injection port 23*a* may be placed shifted from the spiral center of the spiral curve or the center of the base circle for the involute curve.

The other swirl chamber 22*b* and fuel injection port 23*b* are designed by the same method.

Description will be made with reference to FIG. 4. The inner peripheral wall of the swirl chamber 22*a* has a starting end (upstream end) Ss and a terminal end (downstream end) Se. A partially circular portion 27*a* so as to be tangent to the spiral curve at the terminal end (terminal point) Sea is provided at the terminal point Sea. The partially circular portion 27*a* is formed from one end to the other end of the passage 21*a* for swirling and the swirl chamber 22*a* in the height direction (a direction along a central axis of swirling) and, therefore, constitutes a partially cylindrical portion in a predetermined angular range along the peripheral direction. A side wall 21*ae* of the passage 21*a* for swirling is formed so as to be tangent to the cylindrical surface constituted by the partially circular portion 27*a*.

The cylindrical surface constituted by the partially circular portion 27*a* constitutes a connection surface (intermediate surface) connecting the downstream end of the side wall 21*ae* of the passage 21*a* for swirling and the terminal end 22*a* of the inner peripheral wall of the swirl chamber 22*a*. The provision of the connection surface 27*a* enables the provision of a thickness forming portion 26*a* at the connection between the swirl chamber 22*a* and the passage 21*a* for swirling, thereby enabling the swirl chamber 22*a* and the passage 21*a* for swirling to be connected through the wall surface having a predetermined thickness. That is, any sharp shape with a sharp edge such as a knife edge is not formed at the connection between the swirl chamber 22*a* and the passage 21*a* for swirling.

Figure 8:
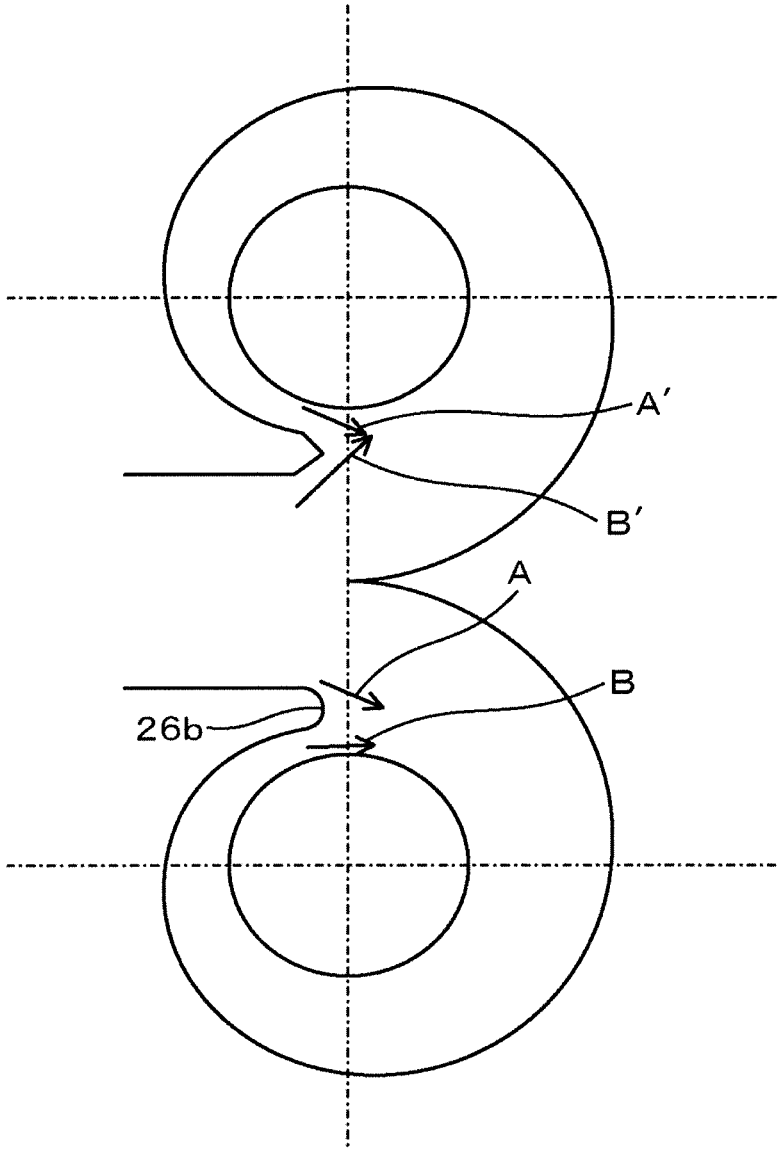
FIG. 8 is a plan view showing flows of fuel in the swirl chambers in the fuel injection valve according to the present invention.

As a result, the collision between fuel circulating through the swirl chambers 22*a* and 22*b* and fuel flowing in from the passage 21*a* for swirling is mitigated to improve the symmetry of swirls (see arrows A and B in FIG. 8).

A starting end (starting point) Ssa of the swirl chamber 22*a* is positioned at a point 24*a* (a meeting face on the swirl chamber upstream side) on the central axis X of the passage 21*a* for swirling. The fuel injection port 23*a* is positioned on a segment Y perpendicular to the point 24*a* on the central axis X (a meeting face on the swirl chamber upstream side), as described later.

The other swirl chamber 22*b* is placed so as to establish a symmetry about the central axis X of the passage 21*a* for swirling.

Similarly, a partially circular portion 27*b* formed so as to be tangent to the spiral curve at the terminal end (terminal point) Seb of the swirl chamber 22*b* is provided at the terminal point Seb. The partially circular portion 27*b* is formed from one end to the other end of the passage 21*a* for swirling and the swirl chamber 22*b* in the height direction (the direction along the central axis of swirling), and therefore, constitutes a partially cylindrical portion in a predetermined angular range along the peripheral direction. A side wall 21*ae* of the passage 21*b* for swirling is formed so as to be tangent to the cylindrical surface constituted by the partially circular portion 27*b*.

The cylindrical surface constituted by the partially circular portion 27*b* constitutes a connection surface (intermediate surface) connecting the downstream end of the side wall 21*ae* of the passage 21*a* for swirling and the terminal end Seb of the inner peripheral wall of the swirl chamber 22*b*. The provision of the connection surface 27*b* enables the provision of a thickness forming portion 26*b* at the connection between the swirl chamber 22*b* and the passage 21*a* for swirling, thereby enabling the swirl chamber 22*b* and the passage 21*a* for swirling to be connected through the wall surface having a predetermined thickness. That is, any sharp shape with a sharp edge such as a knife edge is not formed at the connection between the swirl chamber 22*b* and the passage 21*a* for swirling.

If sharp edge is formed, the fuel circulating through the swirl chambers 22*a* and 22*b* and the fuel flowing in from the passage 21*a* for swirling collide against each other to impair the symmetry of swirls (see arrows A' and B' in FIG. 8).

The allowable size of each thickness forming portions 26*a* and 26*b* is about 0.01 to 0.1 mm, preferably about 0.02 to 0.06 mm.

This thickness is formed to mitigate the collision between the fuel circulating through the swirl chambers 22*a* and 22*b* and the fuel flowing in from the passage 21*a* for swirling, thereby forming smooth flows of fuel along the spiral wall surfaces of the swirl chambers 22*a* and 22*b* (see arrows A and B in FIG. 8).

The fuel injection ports 23*a* and 23*b* are respectively positioned at the spiral centers of the swirl chambers 22*a* and 22*b*. The starting end (starting point) Ssa of the swirl chamber 22*a* and the starting end (starting point) Ssb of the swirl chamber 22*b* are positioned on the segment Y connecting the centers of the fuel injection ports 23*a* and 23*b*.

The sectional shape of the passage 21*a* for swirling perpendicular to the direction of flow is rectangular (oblong). The passage 21*a* for swirling is designed to have a size advantageous in terms of press forming by reducing its height in comparison with its width.

The rectangular portion is formed as a constriction (the minimum sectional area), so that the loss of pressure in the fuel flowing into the passage 21*a* for swirling from the seat portion 3*a* of the valve seat face 3 to the passage 21*a* for swirling via the fuel injection chamber 4, the fuel inlet port 5 and the central hole 25 of the orifice plate 20 is ignorable because of the existence of the constriction.

In particular, the fuel inlet port 5 and the central hole 25 of the orifice plate 20 are designed to form a fuel passage in such a desirable size that no abrupt bend pressure loss is caused.

As a result, the pressure energy in fuel can be efficiently converted into swirl velocity energy at this portion of the passage 21*a* for swirling.

The fuel flow accelerated in this rectangular portion is led to the downstream injection ports 23*a* and 23*b* while maintaining sufficient swirl strength, i.e., swirl velocity energy.

The diameter of the swirl chamber 22*a* is determined so that the influence of friction loss due to the fuel flow and friction loss caused by the interior wall is minimized.

The optimum value of the diameter of the swirl chamber 22*a* is generally considered about four to six times the hydraulic diameter. The method of setting to this value is also used in the present embodiment.

En the present embodiment, as described above, the starting ends (starting points) Ssa and Ssb of the swirl chambers 22*a* and 22*b* respectively coincide with the centers of the fuel injection ports 23*a* and 23*b* in position when viewed from a direction of the central axis X of the passage 21*a* for swirling.

The relationships between the passage 21*b* for swirling, the swirl chamber 22*c* and the fuel injection port 23*c* and the relationships between the passage 21*b* for swirling, the swirl chamber 22*d* and the fuel injection port 23*d* are the same as the above-described relationships between the passage 21*a* for swirling, the swirl chamber 22*a* and the fuel injection port 23*a*. Therefore the description for them will not be repeated.

In the present embodiment, the fuel passages formed by combining the passages 21 for swirling, the swirl chambers 22 and the fuel injection ports 23 are provided at left and right positions. However, the number of fuel passages can be further increased to heighten the degree of freedom of selection from a variety of spray shapes and injection amounts.

The fuel passages formed by combining the passage 21*a* for swirling, the swirl chambers 22*a* and 22*b* and the fuel injection ports 23*a* and 23*b* and the fuel passages formed by combining the passage 21*b* for swirling, the swirl chambers 22*c* and 22*d* and the fuel injection ports 23*c* and 23*d* are identical in arrangement to each other. Therefore, the description will also be made below only of the arrangement on one side illustrated.

The effects and functions of the meeting face 24*a* on the upstream side of the swirl chambers 22*a* and 22*b* (see FIG. 4) and a thickness forming portion 28*a* (see FIG. 5) will be described.

The meeting face 24*a* on the upstream side of the swirl chambers 22*a* and 22*b*, positioned on the central axis X of the passage 21*a* for swirling, is formed as a sharp edge-shaped portion with a sharp point. Such a sharp edge-shaped portion can be formed to have a thickness smaller than 0.01 mm by working techniques currently available.

Figure 5:
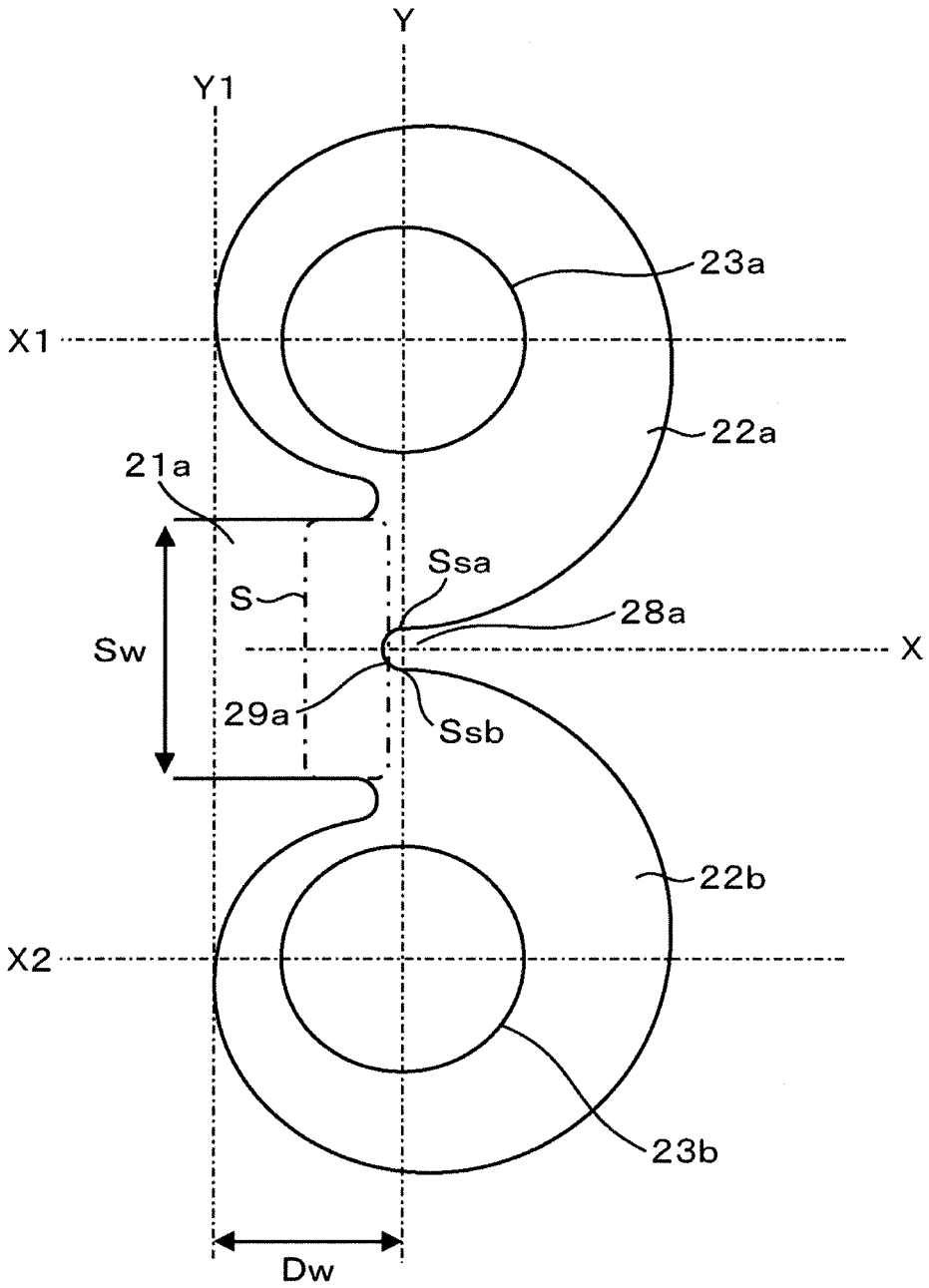
FIG. 5 is a plan view showing the position of a thickness forming portion in the fuel injection valve according to the present invention.

Referring to FIG. 5, when fuel flows into the passage 21*a* for swirling from the central hole 25, a fuel flow (a velocity distribution) in which the velocity in the vicinity of a center is higher than that in the vicinity of the inner peripheral wall 21*ae* is formed at a mid point in the passage 21*a* for swirling. The meeting face 24*a* on the upstream side of the swirl chambers 22*a* and 22*b* disposed on the downstream side of the passage 21*a* for swirling and on the central axis X divides this flow. The flows divided by the meeting face 24*a* on the upstream side of the swirl chambers have distributions in which the velocity is higher on the inner peripheral surface 22*as* and inner peripheral surface 22*bs* sides in the inlet portions of the swirl chambers 22*a* and 22*b*. Therefore, the fuel flows downstream along the inner peripheral surfaces 22*as* and 22*bs* in the swirl chambers 22*a* and 22*b* by being smoothly accelerated. Due to the gradient of the velocity distribution toward the wall side, the collision between the circulating fuel and the flow close to the inner peripheral wall 21*ae* of the passage 21*a* for swirling is mitigated. Moreover, the higher-velocity fuel flows along the inner peripheral surfaces 22*as* and 22*bs* of the swirl chambers 22*a* and 22*b* attract the fuel circulating through the swirl chambers. Therefore the circulating fuel flows smoothly in the swirl chambers 22*a* and 22*b* while being accelerated without causing abrupt flows toward the fuel injection ports 23*a* and 23*b*. As a result, symmetrical flows can be formed at the outlet portions of the fuel injection ports 23*a* and 23*b*.

The thickness forming portion 28*a* positioned at the downstream side of the passage 21*a* for swirling has a partially circular portion 29*a*. The partially circular portion 29*a* is formed by the same method as that of forming the connection surface connecting the downstream end of the side wall 21*ae* of the passage 21*a* for swirling and the terminal end Sea of the inner peripheral wall of the swirl chamber 22*a*. The thickness forming portion 28*a* is formed into a semicircular shape starting from the inlet portions Ssa and Ssb of the swirl chambers 22*a* and 22*b*. Even if an error in positioning occurs such that the central axis X of the passage 21*a* for swirling passing through a center of the semicircular shape deviates from this center by about several microns, fuel is distributed into the swirl chambers 22*a* and 22*b* so that the resulting error in the amounts of fuel flowing into the swirl chambers 22*a* and 22*b* is insignificant. Thus, symmetry property of injected sprays at the outlet portions of the fuel injection ports 23*a* and 23*b* may lie in the range of target values for design.

The thickness forming portion 28*a* is formed so as to be positioned between a first segment Y connecting the centers of the swirl chambers 22*a* and 22*b* (corresponding to the segment connecting the centers of the fuel injection ports) and a fourth segment Y1 connecting points at which a second segment X1 and a third segment X2 including the fuel injection ports of the swirl chambers 22*a* and 22*b* and perpendicular to the first segment Y respectively intersect the wall surfaces of the swirl chambers 22*a* and 22*b* on the side of the passage 21*a* for swirling. Further, if the distance between the first segment Y (corresponding to the segment connecting the centers of the fuel injection ports) and the fourth segment Y1 connecting the points of intersection on the wall surfaces of the swirl chambers 22*a* and 22*b* on the side of the passage 21*a* for swirling is Dw, and if the width of the passage 21*a* for swirling is Sw, the position of the thickness forming portion 28*a* is determined so that the relationship between the distance and width is Sw>Dw.

In this way, the higher-velocity fuel flow in the passage 21*a* for swirling is accurately divided to be evenly distributed into the swirl chambers 22*a* and 22*b*.

The thickness forming portion 28*a* is formed by working operations including necessary corner rounding or chamfering (by about 0.005 mm). The thickness forming portion 28*a* may have a size about 0.01 to 0.1 mm, preferably about 0.02 to 0.06 mm.

Second Embodiment

A fuel injection valve according to a second embodiment of the present invention will be described with reference to FIGS. 6 and 7.

Figure 6:
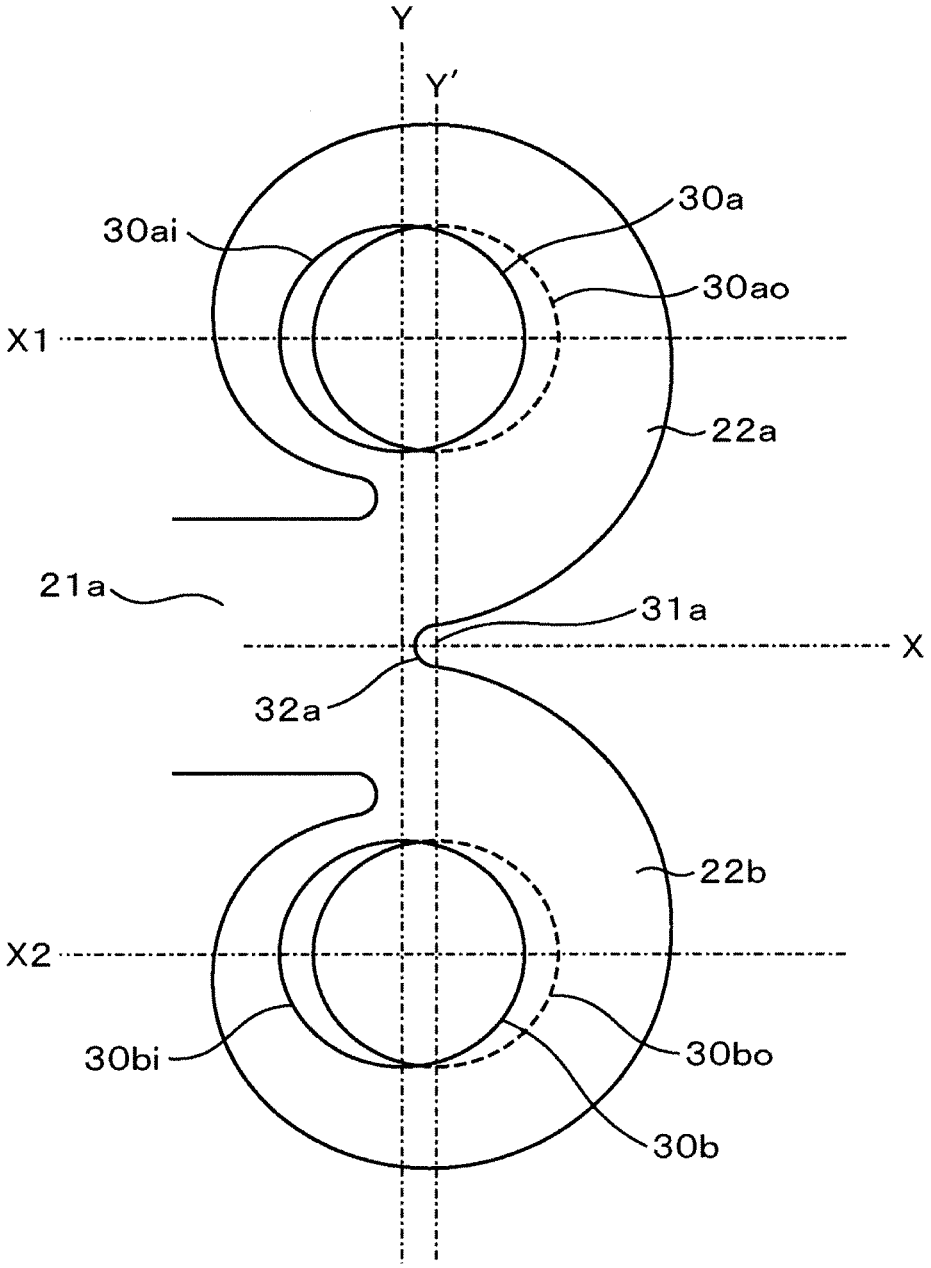
FIG. 6 is a plan view showing a thickness forming portion in a fuel injection valve according to another embodiment of the present invention.
Figure 7:
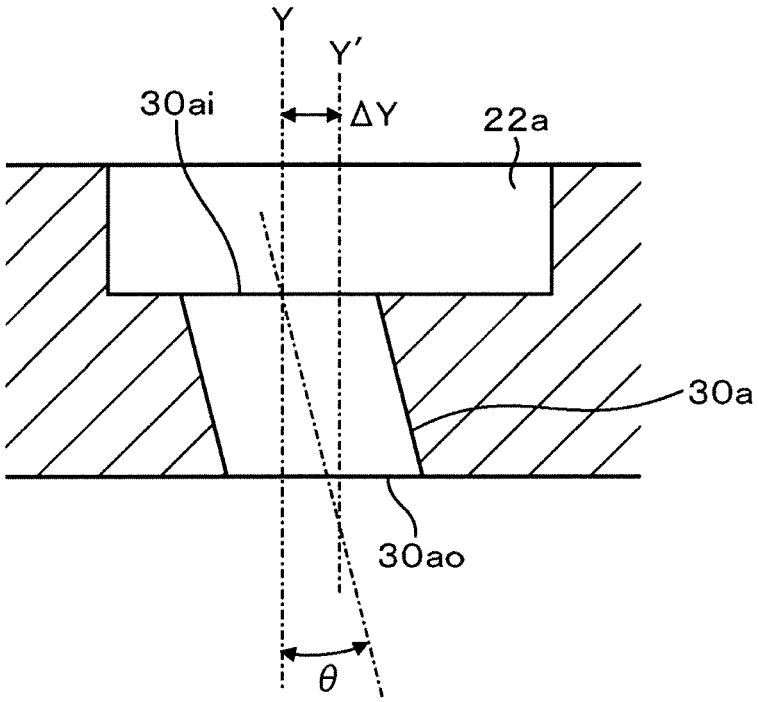
FIG. 7 is a sectional view taken along line X1 in FIG. 6, showing a direction in which the fuel injection port is slanted.

FIG. 6 is a plan view showing the position of a thickness forming portion in the fuel injection valve, as is FIG. 5. FIG. 7 is a sectional view showing a slanted state of a fuel injection port in a section taken along the direction X1 in FIG. 6.

The fuel injection valve according to the second embodiment differs from the fuel injection valve according to the first embodiment in that each fuel injection port is slanted in a desired direction with respect to the valve axial center, and that this slant is accompanied by a shift of the position of a thickness forming portion in a direction corresponding to the slant.

As illustrated, a thickness forming portion 32*a* is positioned on a Y'-axis, which coincides with outlet centers of fuel injection ports 30*a* and 30*b*. That is, the Y'-axis is at a distance of ΔY from the inlet central axis Y. In other words, as shown in FIG. 7, the fuel injection ports are slanted by a slant angle θ. The slant angle θ is designed to be equal to or smaller than 30 degrees. ΔY is designed to be equal to or smaller than 0.1 mm.

By providing these design conditions, the uniformity of fuel liquid film is maintained at the outlet portions of the fuel injection ports 30*a* and 30*b*. As a result, the same functions and effects as those of the first embodiment are obtained.

The above-described embodiments also have arrangements, functions and effects described below.

The diameter of each of the fuel injection ports 23*a* and 23*b* is sufficiently large. If the diameter is increased, the size of the cavity formed in the fuel injection port can be made sufficiently large. This arrangement has the effect of producing thinner film of injected fuel without causing a loss of swirling velocity energy.

Because the ratio of the injection port diameter to the plate thickness of the fuel injection ports 23*a* and 23*b* (the same as the height of the swirl chambers in this case) is reduced, the loss of swirling velocity energy is extremely small. Therefore, the fuel pulverization characteristic is excellent.

Further, since the ratio of the injection port diameter to the plate thickness of the fuel injection ports 23*a* and 23*b* is low, press-workability is improved.

This arrangement has a cost reduction effect, of course, and is capable of limiting size variations, because of the improvement in workability and, therefore, remarkably improves the robustness of the spray shape and injection amount.

As described above, each of the fuel injection valves according to the embodiments of the present invention has, between the passage 21 for swirling and inlet portions of the swirl chambers 22*a* and 22*b*, portions connecting the passage and chambers and thereby forms evenly divided flows along the inner peripheral surfaces in the swirl chambers and can gradually accelerate the flows in downstream directions.

Symmetric (uniform in the peripheral direction about the central axes of swirls) liquid films made thinner by sufficient swirl intensity can be thereby formed at the outlets of the fuel injection ports 23 to promote pulverization.

Between fuel sprays uniformly formed into thin films and surrounding air, energy exchange is actively performed to promote breakup and produce well pulverized sprays.

Design features that facilitate press working are provided to obtain a low-priced fuel injection valve of improved cost/performance.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A fuel injection valve comprising:

a slidable valve element;

a valve seat member having a valve seat formed thereon and an opening at a downstream side, the slidable valve element being seated on the valve seat at a time of valve closing;

a passage for swirling provided at each of two opposite downstream sides of a central hole, the passage for swirling communicating with the opening of the valve seat member;

at least one swirl chamber formed on a downstream side of the passage for swirling, an entirety of the at least one swirl chamber having a curved inner surface and causing fuel to swirl in an interior of the at least one swirl chamber so as to give swirling force to the fuel; and at least one fuel injection port having a cylindrical shape and being formed in a bottom portion of the at least one swirl chamber, the fuel being injected outside through the at least one fuel injection port, wherein the passage for swirling has two swirl chambers at a downstream end thereof, the two swirl chambers defining individual chambers, at least two immediately adjacent swirl chambers share a common starting end, the common starting end dividing one stream of fuel flowing from the passage for swirling into two separate streams of fuel such that only one of the two separate streams of fuel flows into each of the at least two immediately adjacent swirl chambers, and fuel in one of the at least two immediately adjacent swirl chambers flows in a clockwise direction, and fuel in another of the at least two immediately adjacent swirl chambers flows in a counter clockwise direction.

2. The fuel injection valve according to claim 1, wherein the two swirl chambers have wall surfaces, the wall surfaces having first ends that are connected to the downstream end of the passage for swirling and that are positioned at a center in a width direction of the passage for swirling and that form a partition wall having a predetermined thickness.

3. The fuel injection valve according to claim 2, wherein the first ends of the wall surfaces are positioned between outer wall surfaces of the at least one swirl chamber (a segment Y1) on a side of the passage for swirling and centers of the at least one fuel injection port (a segment Y).

4. The fuel injection valve according to claim 2, wherein the partition wall has a partially circular section.

5. The fuel injection valve according to claim 4, wherein the two swirl chambers and the passage for swirling are formed in a configuration in which a relationship between Dw and Sw is represented by the formula:

$$Sw>Dw$$

wherein Dw is a distance from a first segment Y connecting centers of the swirl chambers to a fourth segment Y1 connecting the wall surfaces of the two swirl chambers on the side of the passage for swirling, and Sw is a width of the passage for swirling.

6. The fuel injection valve according to claim 1, wherein the at least one swirl chamber has a section of an involute curve or a spiral curve.

7. The fuel injection valve according to claim 1, wherein each of the two swirl chambers has a respective fuel injection port.

8. The fuel injection valve according to claim 1, wherein the divider portion is edge-shaped.

9. The fuel injection valve according to claim 1, wherein the divider portion is a thickness forming portion.

10. The fuel injection valve according to claim 1, wherein the starting end of each swirl chamber is joined together by a region having a convex shape.

11. A fuel injection valve comprising:

a slidable valve element;

a nozzle body having a valve seat formed at a first end thereof, the slidable valve element being seated on the valve seat at a time of valve closing; and an orifice plate fixed to a second end of the nozzle body, the orifice plate including at least one swirl chamber an entirety of which having a curved inner surface that gives swirling force and a passage for swirling, provided at each of two opposite downstream sides of a central hole, through which fuel is supplied to the at least one swirl chamber, wherein the passage for swirling has two swirl chambers at a downstream end thereof, the two swirl chambers defining individual chambers, at least two immediately adjacent swirl chambers share a common starting end, the common starting end dividing one stream of fuel flowing from the passage for swirling into two separate streams of fuel such that only one of the two separate streams of fuel flows into each of the at least two immediately adjacent swirl chambers, and fuel in one of the at least two immediately adjacent swirl chambers flows in a clockwise direction, and fuel in another of the at least two immediately adjacent swirl chambers flows in a counter clockwise direction.

12. The fuel injection valve according to claim 11, wherein each of the two swirl chambers has a respective fuel injection port.

13. The fuel injection valve according to claim 11, wherein the divider portion is edge-shaped.

14. The fuel injection valve according to claim 11, wherein the divider portion is a thickness forming portion.

15. The fuel injection valve according to claim 11, wherein the starting end of each swirl chamber is joined together by a region having a convex shape.

* * * * *